US009966049B2

(12) United States Patent
Küng et al.

(10) Patent No.: US 9,966,049 B2
(45) Date of Patent: May 8, 2018

(54) MUSICAL INSTRUMENT FOR PREVENTING PLAYER'S BODY FROM DAMPING VIBRATIONS

(71) Applicant: RELISH BROTHERS AG, Kriens (CH)

(72) Inventors: Silvan Küng, Lucerne (CH); Pirmin Giger, Kriens (CH)

(73) Assignee: Relish Brothers AG, Kriens (CH)

( * ) Notice: Subject to any disclaimer, the term of this patent is extended or adjusted under 35 U.S.C. 154(b) by 0 days. days.

(21) Appl. No.: 15/526,936

(22) PCT Filed: Nov. 13, 2015

(86) PCT No.: PCT/IB2015/058780
§ 371 (c)(1),
(2) Date: May 15, 2017

(87) PCT Pub. No.: WO2016/075664
PCT Pub. Date: May 19, 2016

(65) Prior Publication Data

US 2017/0337907 A1 Nov. 23, 2017

(30) Foreign Application Priority Data

Nov. 13, 2014 (EP) ..... 14193118

(51) Int. Cl.
*G10D 3/18* (2006.01)
*G10D 1/08* (2006.01)
*G10D 3/02* (2006.01)

(52) U.S. Cl.
CPC ..... *G10D 3/18* (2013.01); *G10D 1/085* (2013.01); *G10D 3/02* (2013.01)

(58) Field of Classification Search
CPC ..... G10D 3/02; G10D 1/085
See application file for complete search history.

(56) References Cited

U.S. PATENT DOCUMENTS 4,169,402 A 10/1979 Wood
5,939,652 A 8/1999 Jones
2003/0121393 A1 7/2003 Brown
(Continued)

FOREIGN PATENT DOCUMENTS

GB 2355574 A 4/2001

*Primary Examiner* — Kimberly Lockett
(74) *Attorney, Agent, or Firm* — Edwin D. Schindler

(57) ABSTRACT

A musical instrument, particularly a stringed instrument, has a structure that decouples the body of the player from all parts of the instrument which are indirectly responsible for the sound production for preventing the body of the player from damping the vibrations of the instrument. Instead of a top cover being the main source of indirect sound production, the musical instrument now has an annular plate which is positioned between covers. Any damping effect on the resonance of the annular plate is minimized by positioning a bridge on the annular plate to avoid any contact between the bridge and the top cover, and applying an acoustically decoupling layer between the covers and the annular plate. The covers provide protection against any damping effect of the player's body on the annular plate. This structure also minimizes the tendency of an acoustic feedback loop,2 which may occur in the case of an electrically amplified stringed instrument.

14 Claims, 7 Drawing Sheets

(56) References Cited

U.S. PATENT DOCUMENTS

| | | | | |
|---|---|---|---|---|
| 2005/0211052 | A1 | 9/2005 | Gigliotta | |
| 2007/0095192 | A1* | 5/2007 | Moore | G10D 3/04 84/298 |
| 2008/0532288 | | 3/2008 | Brunkalla | |
| 2008/0105101 | A1* | 5/2008 | Eldring | G10D 1/085 84/291 |
| 2008/0127800 | A1 | 6/2008 | Koentopp | |

* cited by examiner

MUSICAL INSTRUMENT FOR PREVENTING PLAYER'S BODY FROM DAMPING VIBRATIONS

BACKGROUND OF THE INVENTION

Field of the Invention

The present invention relates to musical instruments and more specifically to the structure of stringed musical instruments.

Description of the Related Art

The basic structure of a stringed instrument is well known, wherein a neck is connected to a body. The body consist of a side wall to which a top cover and a bottom cover are connected. These body parts form a resonance chamber. A bridge is connected to the top cover. Strings are stretched taunt from the head of the neck across a bridge to a tailpiece.

Plucking or strumming the strings causes them to vibrate. The top surface of the neck serves as a finger board which can be fretless or fretted. By depressing a string against the finger board the length of the string to the bridge changes thus changing the frequency the string vibrates at when plucked or strummed.

As the bridge over which the strings are stretched taunt is connected to the top cover the vibrating strings will cause the top plate to vibrate which in turn will amplify and project the sound wave produced by the instrument. The top cover the side wall and the bottom plate form a resonating chamber which further shapes and projects the sound waves created by the vibrating top cover.

Musical instruments have parts that are directly responsible as well as parts that are indirectly responsible for the production of sound waves. Parts directly responsible for the production of sound waves are intentionally caused by the player to vibrate, e.g. the strings of a stringed instrument or piano, a drumhead or the reed of a woodwind. The frequency of the vibration determines the pitch and the amplitude the volume of the acoustic event. Parts indirectly responsible for the production of sound waves, e.g. the top cover of a stringed instrument or the shell of a drum, vibrate under stimulation by the vibration of the parts directly responsible for the production of sound waves.

Together, parts directly responsible for the production of sound waves and parts that are indirectly responsible account for the intended production of the sound waves of a musical instrument. These sound waves account for what we call the sound, tone and timbre of a musical instrument.

There are auxiliary parts of musical instruments which play a role in the intended production of sound waves but which do not participate in the vibrations creating the sound waves, e.g. the keys and pedals of a piano, a bracket holding a drum shell or the tuning heads of a guitar with which the tension of the strings can be increased and decreased. Any sound waves such auxiliary parts produce are considered disruptive and unwanted acoustic contributions. Their audibility should be minimised and their transfer to the resonating parts of the instrument should be prevented as much as possible, i.e. these auxiliary parts should be acoustically decoupled from the parts which are intended to directly or indirectly create sound waves. This decoupling can be achieved with the help of intermediate layers of materials which sound waves can only travel through at significantly lower speed compared to the materials used for the construction of parts intended to produce sound waves.

If parts indirectly responsible for the production of sound waves are prevented from vibrating freely, e.g. because the musician touches them, then this will cause an unwanted acoustic contribution, e.g. in the form of an excessive damping of vibrations. This can be prevented by means of protective parts such as e.g. the chin rest of a violin or the enclosure of the pate and strings of a grand piano. These protective parts should be acoustically decoupled from the parts which are intended to directly or indirectly create sound waves Today's music performances often require musical instruments to be electronically amplified. One mayor disadvantage associated with amplifying stringed instruments is feedback originating from their hollow body and in particular from their top cover.

A stringed electronic instrument such as an electric guitar is equipped with pickups that are arranged on the body and convert the vibrations of the strings to electric signals which are sent via a volume and a tone control unit to the input of an electronic amplifier.

With increasing amplification the top cover of a stringed instrument will start to vibrate in response to the vibrations coming from loud speakers projecting the amplified sound. Via the bridge which is connected to the top cover the strings will vibrate thus closing a feedback loop which, when uncontrolled, is undesirable.

Numerous patents have been filed addressing the issue of undesired feedback. Various approaches suggest a semi-hollow body instrument introducing an internal body structure which the top and bottom covers are connected to preventing these covers from vibrating excessively and thus making them more resistant to feedback while at the same time designing the internal body structure in a way that favours the sustain and the sound projection of the stringed instrument and therefore not adversely affecting the tone of the instrument. The bridge is connected to the top cover and therefore what is said about the top cover regarding resistance to feedback can equally be said about the bridge. The internal body structure also provides structural support to the body of the stringed instrument.

U.S. Pat. No. 6,459,024 B1 suggests a torsion brace as internal body structure contacting the upper and lower covers in only three locations. This should let the covers vibrate freely and at the same time increase the resistance to feedback while not affecting the sound projection and sustain adversely. The bridge is connected to the top cover at a location where the internal body structure contacts the top cover.

In US 2008/0202310 A1 the internal body structure includes a support member or block and a structural element positioned in the chamber formed by the side wall, top and bottom covers of the body. The block should further increase the sustain of the instrument. Connected to the top and bottom covers the block together with the structural element provides additional support and stiffness enabling further control of the overall vibration and thus the resonance of the stringed instrument. The bridge is connected to the top cover and is located above the block In U.S. Pat. No. 7,863,507 B2 a plurality of resonance-enhancing baffle pairs are added to the internal structure to further increase the sustain as well as enrich the resonant tone of the instrument. The bridge is connected to the top cover and both top and bottom covers are connected to the internal body structure.

The internal body structure in U.S. Pat. No. 6,646,189 B2 together with the top and bottom covers is said to improve the sound quality, the rigidity, and the appearance of the stringed instrument. This invention is focussed on a compartment inside the body in which all electronic parts can be stowed away. The internal structure is rigidly connected to the top and bottom covers and the bridge is rigidly connected to the top cover.

A solid body stringed instrument has no resonating chamber with top and bottom covers. It therefore is very resistant to feedback and has excellent sustain qualities. On the other hand it lacks the capability to produce complex resonant tones.

Semi-hollow body stringed instruments limit excessive vibration of the top and bottom covers by introducing an internal body structure to which the covers are connected thus increasing the resistance to feedback. The energy of the sound waves coming from the loud speakers not only causes the top cover to vibrate but also the entire internal body structure the cover is connected to. Increasing the mass which is caused to vibrate by the energy of the sound waves moves the point of uncontrolled feedback to a sound volume beyond the level used during performances.

But the positive effect on sustain and sound projection very much depends on how the instrument is held by the player while playing. A guitar e.g. very often is strapped to the player who is standing upright. In this case the suggested solutions do not take into consideration that the body of the player has a strong damping effect on the top and bottom covers and as they are connected to the internal body structure, substantially reducing sustain and sound projection of the instrument. This equally applies to solid body instruments.

The damping effect the player can have on the parts of the instrument which are indirectly responsible for the sound can not be controlled as it depends on the size, shape and surface of the player's body. The influence of a player on the sound of the instrument will even vary with the clothes he is wearing.

In US 2009/0320666 A1 a method and materials are described to decouple the part of a musical instrument that is directly responsible for producing the primary sound event from the elements and components that are not directly involved in producing the primary sound event.

The above method prevents the parts of a musical instrument which have been described earlier as irrelevant to the sound production from resonating, i.e. from producing disruptive sound or noise.

Therefore it is an object of the present invention to provide a new structure for a stringed instrument which prevents the body of the player from damping the vibrations of these parts.

This object is accomplished with a musical instrument comprising a neck including a fingerboard and headstock with tuning heads, an annular plate which on one end is designed to receive and secure said neck of said musical instrument, a block having a first and a second end whereby both ends are connected to said annular plate, a bridge connected to said block, at least one string attached on a first end to said tuning heads stretched taunt across said bridge and attached on a second end to said block, accounting for the portion of said musical instrument responsible for direct and indirect production of sound waves, characterized by a top and a bottom cover acoustically decoupled from said portion responsible for direct and indirect production of sound waves of said musical instrument and connected to said annular plate by means that influence the amount of sound conduction between said covers and said plate.

This musical instrument focuses on the parts of a musical instrument which are indirectly responsible for sound production and how they can be decoupled from the damping effect of the body of the player holding the instrument.

SUMMARY OF THE INVENTION

The present invention provides a musical instrument increasing the resistance to feedback and providing sustain while at the same time decoupling the body of the player holding the instrument from all parts of the instrument which are indirectly responsible for sound production thus avoiding a damping effect on these parts.

BRIEF DESCRIPTION OF THE DRAWINGS

The preferred embodiments will be described with reference to the following figures.

DESCRIPTION OF THE PREFERRED EMBODIMENTS

Figure 1:
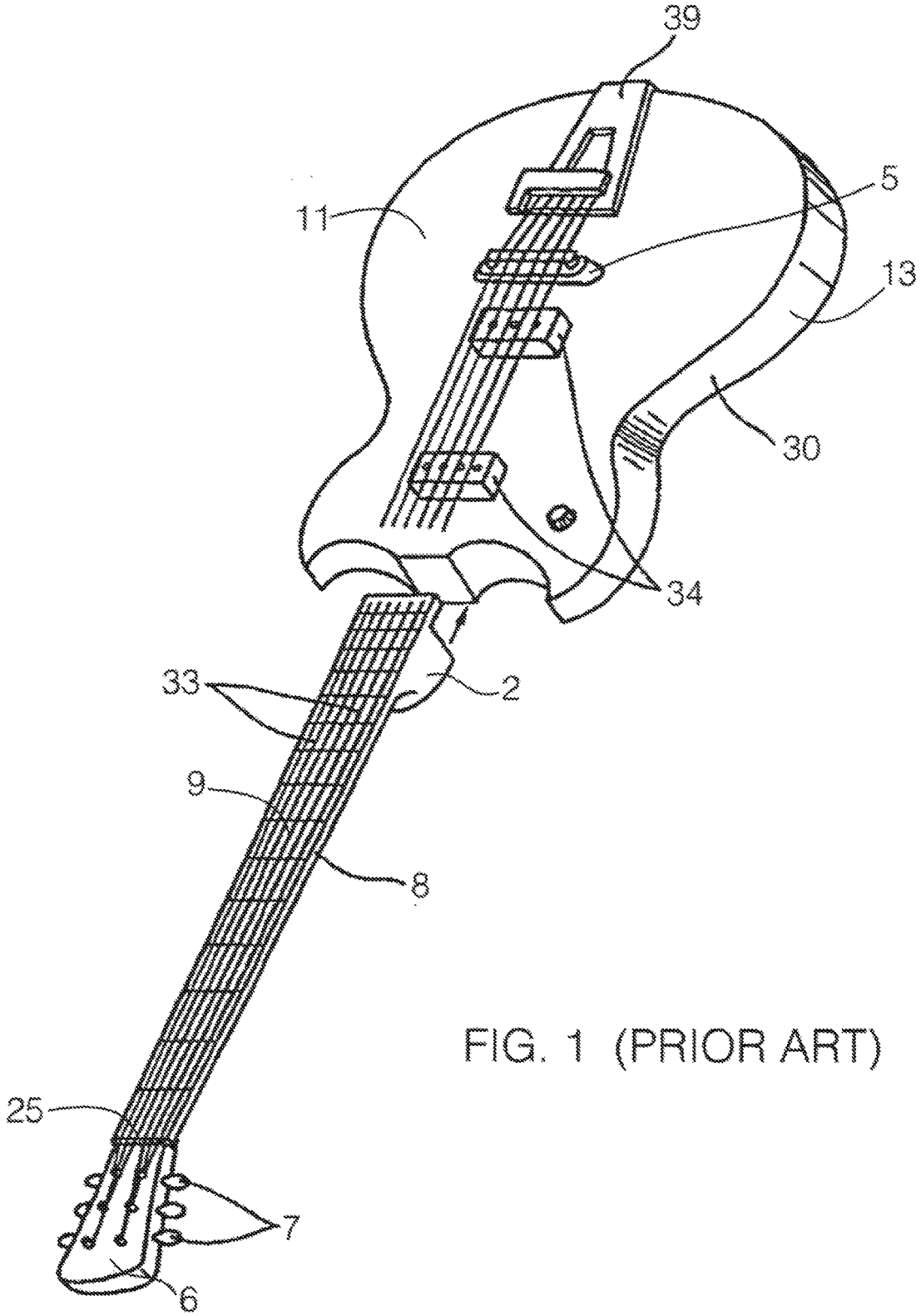
FIG. 1 (PRIOR ART)
FIG. 1 shows a perspective illustration of an electric guitar.

According to a preferred embodiment the stringed instrument is a guitar having the following parts which are indirectly responsible for sound production, as shown in FIG. 1 (prior art): An annular plate 1, a block 3 connected to the annular plate 1, a neck 2 with fingerboard 8 connected to the annular plate 1, a top bridge or nut 25 between the neck 2 and the headstock 6, and a bottom bridge 5 connected to the block 3.

Figure 3:
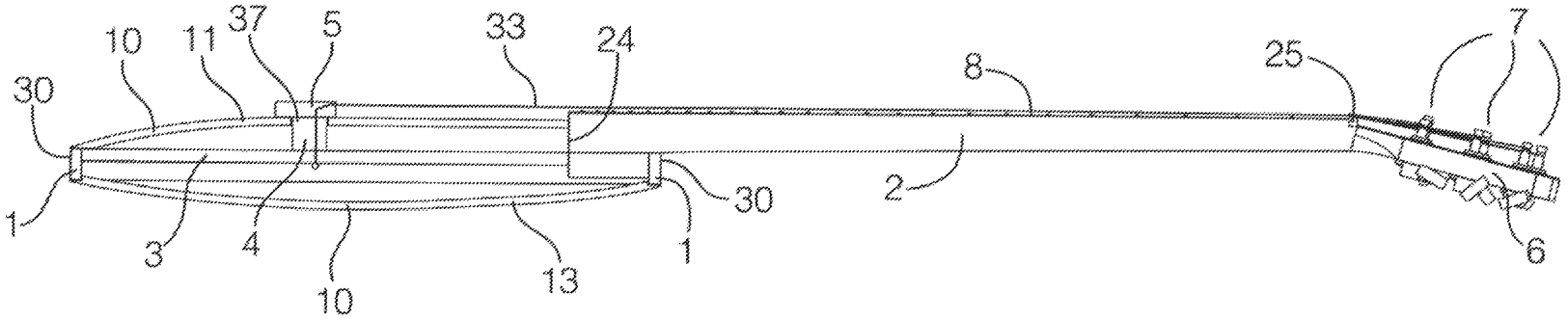
FIG. 3 shows a partially cross-sectional and partially side view of parts an electric guitar according to a preferred embodiment.

The strings 33 which are directly responsible for sound production are stretched taunt from the tuning machines 7 connected to the headstock 6 at one end, across the nut 25 and bridge 5 and secured to the block 3 at the other end. Any pitch bending device also has to be attached to the block 3 and must not be in contact with the covers 10 (FIG. 3).

Figure 3A:
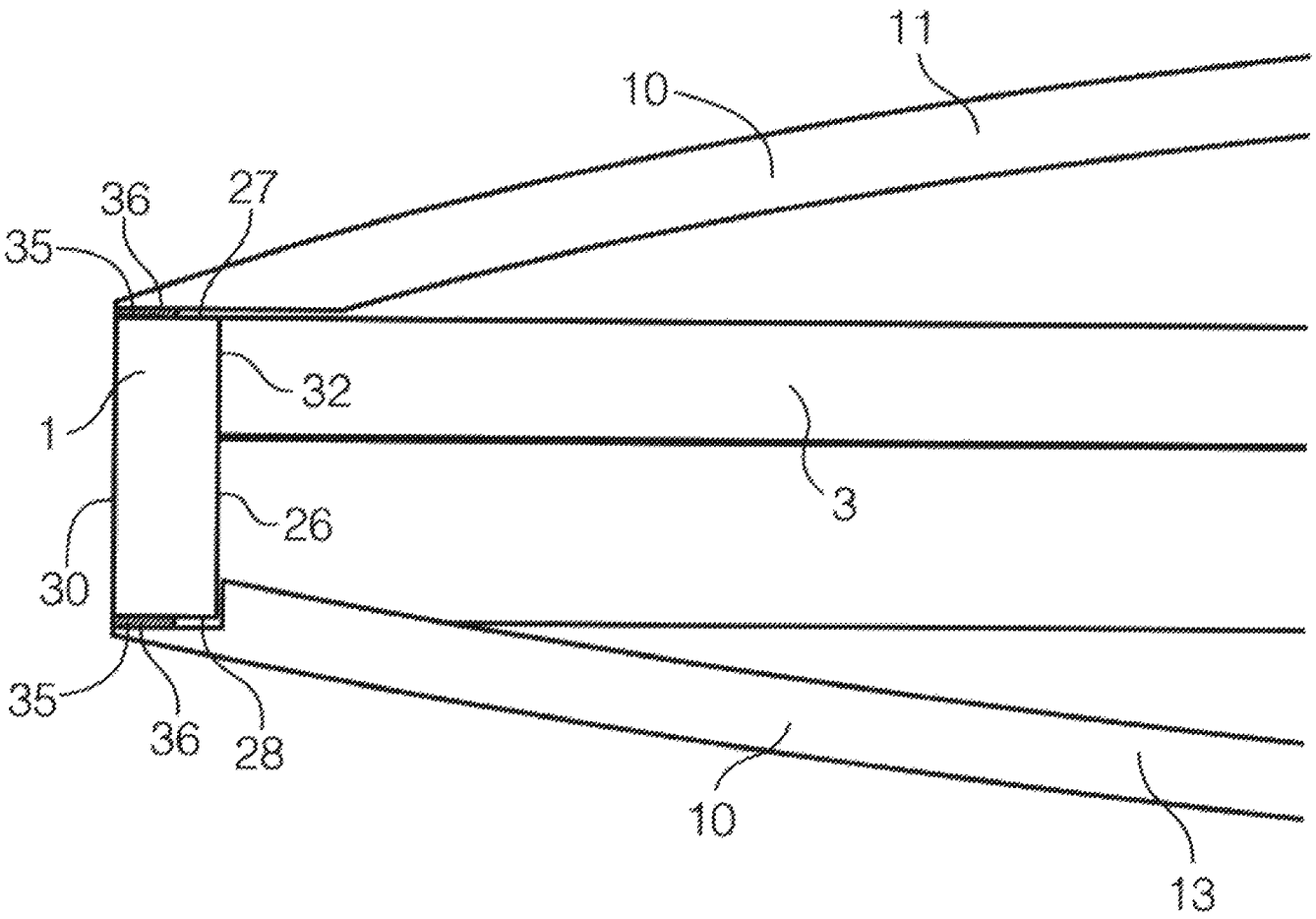
FIG. 3*a* shows a cross-sectional view of the tail of the guitar body.
Figure 4:
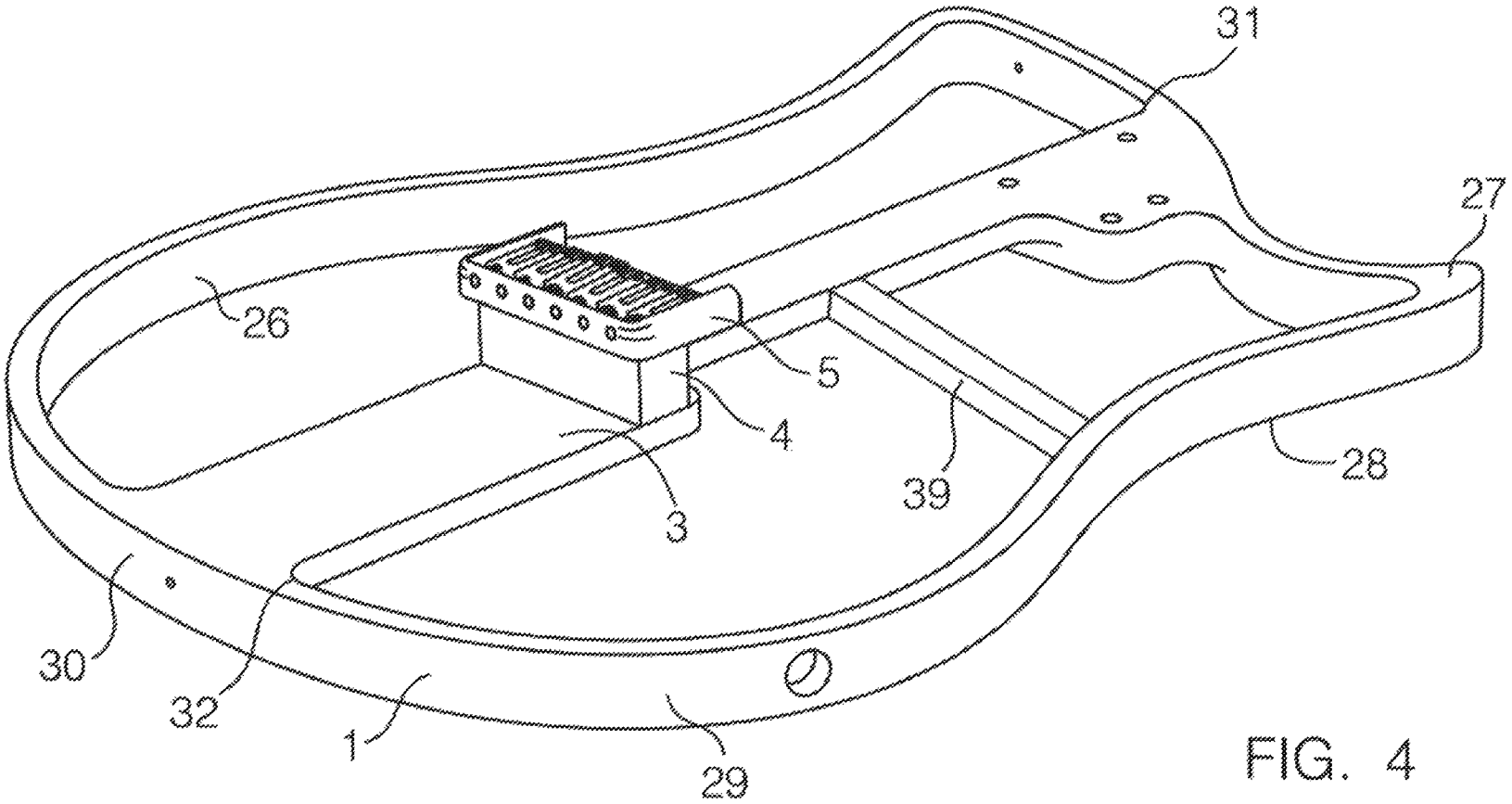
FIG. 4 shows a perspective illustration of the annular plate.
Figure 5:
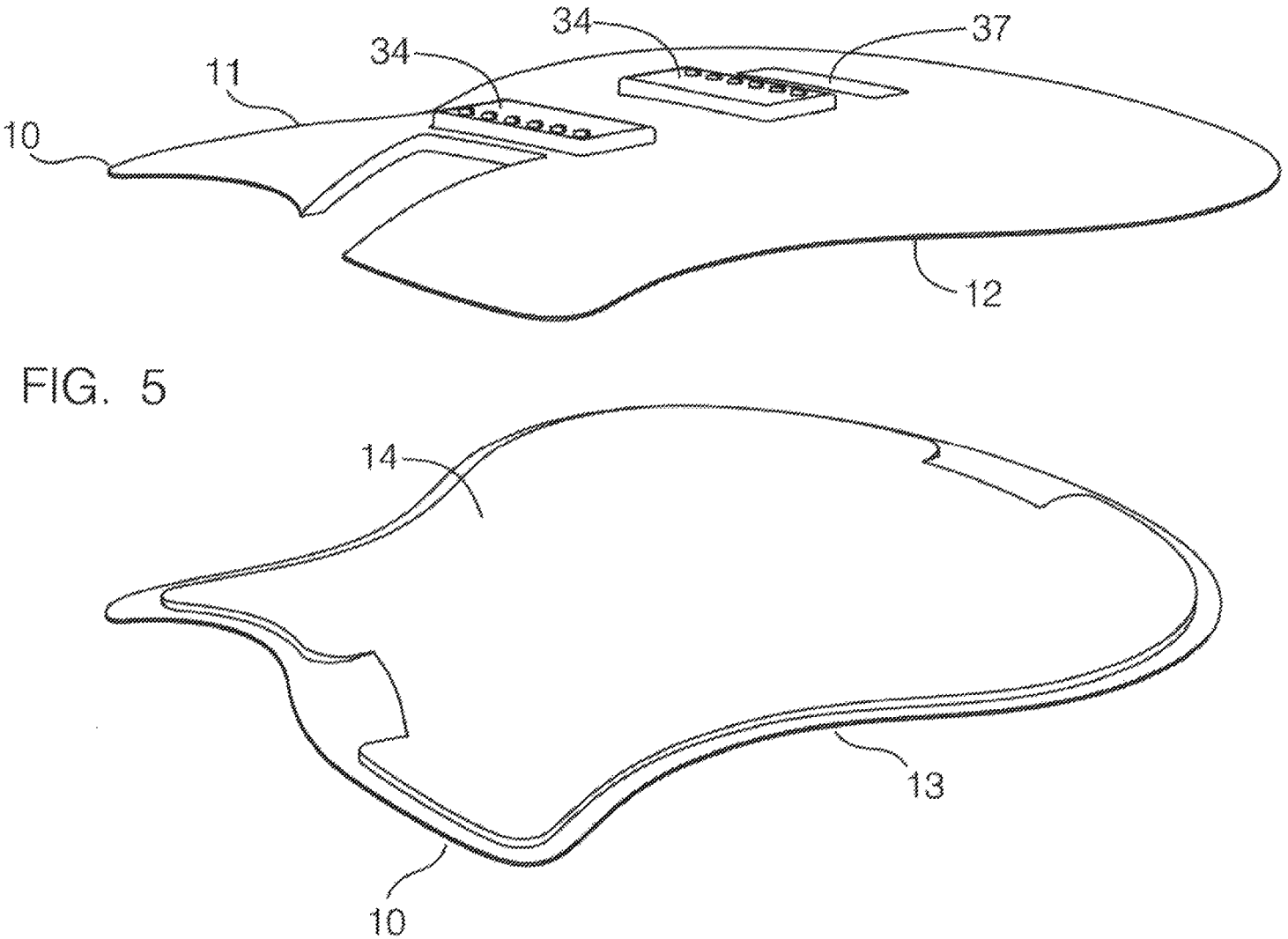
FIG. 5 shows a perspective view of the covers.
Figure 6:
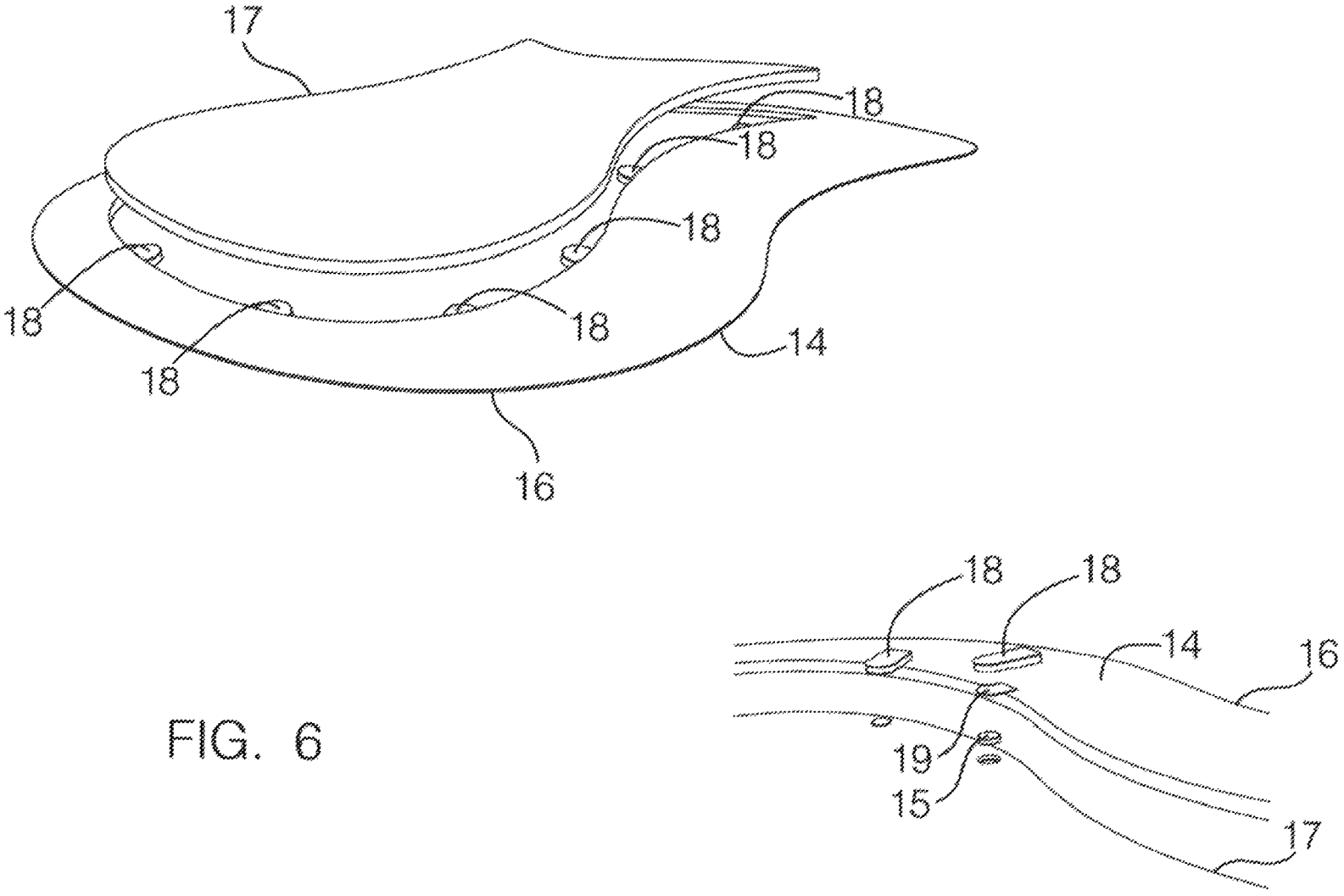
FIG. 6 shows a perspective view of a preferred embodiment featuring the bottom cover with a rim and lid.

The top and bottom covers 10 serve as elements decoupling the player's body from the parts of the instrument that are relevant to sound production. These covers 10 which are in contact with the body of the player while holding the instrument are attached to the annular plate 1 using adhesive material 35 (FIG. 3*a*), through which sound travels at significantly lower speed than through the parts of the instrument which are relevant for sound production. In some embodiments a layer of acoustically decoupling material 36 (FIG. 3*a*) is added between the covers 10 and the plate 1. Except for the annular plate 1 and pickups 34 no other parts of the stringed instrument are in contact with the covers 10. This prevents the parts relevant for sound production from being dampened by the body of the player.

The way the covers 10 are mounted to the plate 1 controls the amount of sustain of the basic resonating system consisting of strings 33, plate 1, block 3 and neck 2. They can be mounted with elastic adhesive material or spring mounted or magnetically mounted or electromechanically mounted.

According to a preferred embodiment of the invention, the musical instrument is an electric guitar with pickups 34 detecting vibrations of the strings 33 converting these vibrations to electric signals which can be sent to the input of an amplifier (not shown) via a volume unit (not shown). The pickups 34 are connected to the block 3 or to the top cover 11.

According to a preferred embodiment the annular plate 1 and the block 3 are made of Aluminium.

For descriptive purposes the invention relates the construction of an electric guitar but this is not intended to limit the scope of the invention its application or uses for it can apply to any musical instrument such as acoustic or electric violins, guitars, bass guitars, mandolins, cellos, basses or other instruments.

FIGS. 2-6 illustrate a musical instrument according to the present invention. According to a preferred embodiment the musical instrument is an electric guitar.

Figure 2:
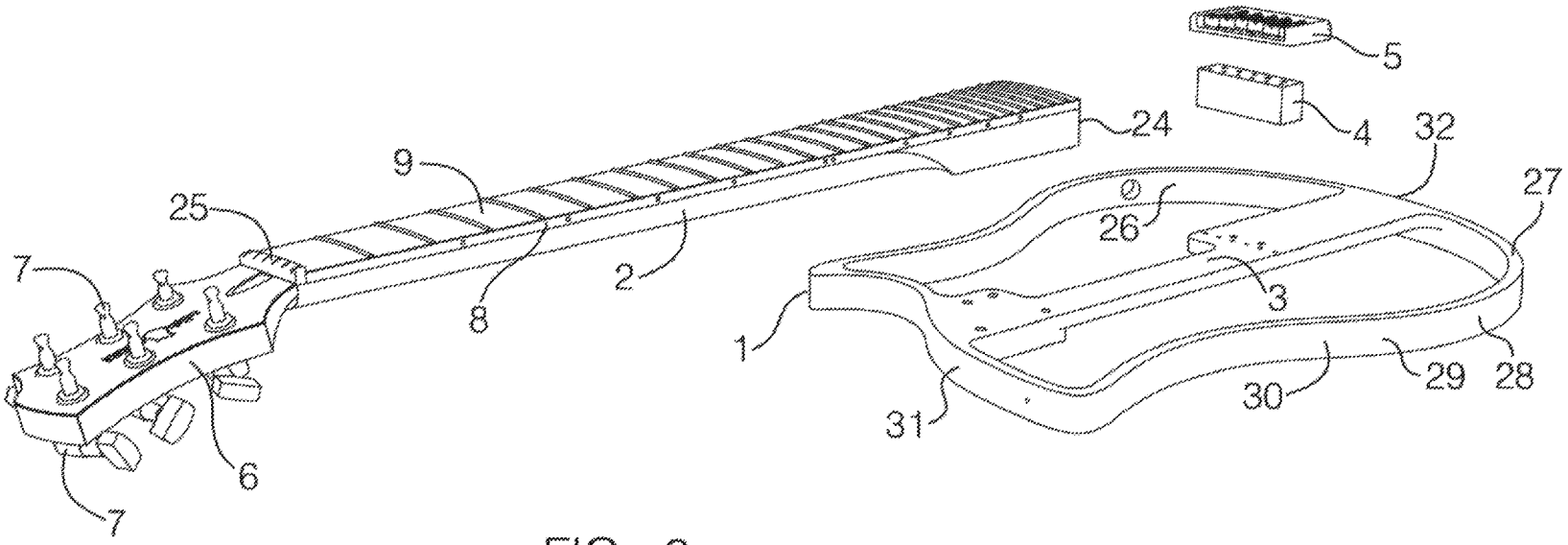
FIG. 2 shows a perspective illustration in an exploded view of the parts relevant to sound production according to a preferred embodiment.

FIG. 2 shows the components of an electric guitar responsible for sound production according to the invention. These components include an annular plate 1, a neck 2 with a fingerboard 8, a block 3, a nut 25, a bridge 5 and a plurality of strings 33 stretched taunt across the nut 25 and bridge 5.

The annular plate 1 is glued or bolted to the heel 24 of the neck 2 and serves a number of purposes, i.e. it gives structural support and rigidity, forming a wall 30 located between the top and bottom covers 10 defining the outline of the body. It creates sustain and tone and provides a chamber in which a block 3 and electronic components (not shown) can be placed. In order to create instruments with different sound timbres the annular plate can be made of a plurality of materials such as e.g. wood, laminate material, metal, in particular aluminium, composite material or carbon fibre.

The annular plate 1 has a top surface 27, a bottom surface 28, an inner surface 26 and an outer 29 surface. The inner surface 26 defines the chamber in which the block 3 is placed. The top and bottom surfaces hold the adhesive interface securing and acoustically decoupling the covers 10. The outer surface 29 serves as sidewall 30 of the body.

An oblong block 3 is connected to the inside surface 26 at the head 31 and tail 32 of the annular plate 1. The block 3 is not in contact with the covers 10. According to the preferred embodiment the annular plate 1 and the block 3 are made of one piece forming a continuous structure which the neck 2 is glued or bolted on to as a separate piece.

Depending on the materials used and the method of production the following embodiments can be advantageous with regards to mechanical stability and production cost:

- the neck 2 and the block 3 are made of one piece forming a continuous structure which the annular plate 1 is glued or bolted on to as a separate piece.
- the annular plate 1, the block 3 and the neck 2 are made of one piece forming a continuous structure.
- the annular plate 1, the block 3 and the neck 2 are formed of 3 separate pieces glued and/or bolted together.

According to a further embodiment only one end of the block 3 is connected to the head 31 of annular the plate 1. The other end is not connected and extends inwardly towards the tail 32 of the plate 1 providing a gap between the other end of the block and the inner surface 26 at the tail 32 of the annular plate 1. This construction allows the block 3 to vibrate more freely.

According to a further embodiment only one end of the block 3 is connected to the tail 32 of annular plate 1. The other end is not connected and extends inwardly towards the head 31 of the plate 1 providing a gap between the other end of the block and the inner surface 26 at the head 31 of the annular plate 1. This construction allows the block 3 to vibrate more freely.

According to a further embodiment for stability reasons there is at least one cross member 39 between the block 3 and the annular plate 1.

A bridge support 4 connected to the block 3 protrudes the top cover 11. The opening 37 in the top cover 11 is large enough to provide a small gap around the bridge support 4 so that it is not in direct contact with the top cover 11. In the present embodiment the annular plate 1 and the bridge support 4 are formed of two separate pieces but they could equally be formed of a single piece of material.

The bridge 5 is mounted on the bridge support 4 so that bridge 5 and top cover 11 are not in direct contact with each other.

The covers 10 are not relevant to the sound production of the instrument. Their main purpose is to cover the block 3 and the annular plate 1 preventing these parts relevant to sound production from getting in direct contact with the body of the player. They also define the finish and look of the instrument and can be flat or arched, made of wood, laminate material, metal, composite material or carbon fibre According to the preferred embodiment the bottom cover 13 consists of two parts, a rim 16 and a lid 17. The rim 16 is fixed to the bottom surface 28 of the annular plate 1 by means of acoustically decoupling adhesive material 35. The lid 17 can be opened and closed thus providing access to the chamber defined by the inner surfaces 26, 27, 28, 29, 12 and 14 of the covers 10 and the annular plate 1. This access is necessary for maintenance if the chamber contains electronic components. The majority of the surface of the back cover 13 can consist of lid 17 which is fastened to the rim 16 by mechanical or magnetic means, elastically supporting the lid which further facilitates acoustical decoupling. In the preferred embodiment padded 19 iron brackets 18 are attached to the inner surface 14 on the edge of the opening of the rim 16 and magnets 15 are inserted through the inner surface 14 at the appropriate positions around the edge of the lid 17 holding it in position by magnetic force.

According to a further embodiment the acoustically decoupling interface between the to surfaces 27 and 28 of the annular plate 1 and the covers 10 consists of three layers: an adhesive layer 35 followed by a layer which reduces sound conduction 36 followed by an adhesive layer 35.

According to the preferred embodiment electromagnetic pickups 34 are being used to convert the vibration of the strings 33 to electric signals. Further embodiments include piezoelectric pickups (not shown) or microphones (not shown).

LIST OF NUMERALS

1 annular plate
2 neck
3 block
4 bridge support
5 bridge
6 headstock
7 tuning heads aka tuning machines or tuning pegs
8 fingerboard
9 fret
10 covers

11 top cover
12 inner surface of the top cover
13 bottom cover
14 inner surface of the bottom cover
15 magnet
16 rim of bottom cover
17 lid of bottom cover
18 iron brackets
19 padding
24 heel
25 nut
26 inner surface of annular plate
27 top surface of annular plate
28 bottom surface of annular plate
29 outer surface of annular plate
30 side wall
31 head
32 tail
33 strings
34 electromagnetic pickups
35 adhesive layer
36 material for acoustic decoupling
37 opening
39 cross member

What is claimed is:

1. A musical instrument for preventing a player's body from damping vibrations, comprising:

an indirect sound production portion comprising a neck having a fingerboard and a headstock with tuning heads, an annular plate having a first end for receiving and securing said neck, a block having a first end and a second end with at least one of said first end and said second end being connected to said annular plate and a bridge with a support connected to said block;

a direct sound production portion comprising at least one string attached on a first end of said at least one string to said tuning heads stretched tautly across said bridge and attached on a second end of said at least one string to said block; and, an enclosing portion comprising a top cover and a bottom cover attached to said annular plate, wherein said top cover provides for an opening for said support of said bridge, said top cover and said bottom cover being acoustically decoupled from said direct sound production portion and said indirect sound production portion by an acoustically decoupling interface provided between said annular plate and said top cover and said bottom cover so that sound travels between said annular plate and said top cover and bottom cover at lower speed than through said direct sound production portion and said indirect sound production portion.

2. The musical instrument for preventing a player's body from damping vibrations according to claim 1, wherein said top cover and said bottom cover are attached to said block.

3. The musical instrument for preventing a player's body from damping vibrations according to claim 1, wherein said annular plate, said block and said support of said bridge form a continuous structure.

4. The musical instrument for preventing a player's body from damping vibrations according to claim 1, wherein between said support for said bridge and said top cover, a gap is provided.

5. The musical instrument for preventing a player's body from damping vibrations according to claim 1, wherein said acoustically decoupling interface is a magnetic device.

6. The musical instrument for preventing a player's body from damping vibrations according to claim 5, wherein said magnetic device includes magnetic fasteners.

7. The musical instrument for preventing a player's body from damping vibrations according to claim 1, wherein said acoustically decoupling interface comprises a material layer.

8. The musical instrument for preventing a player's body from damping vibrations according to claim 7, wherein said material layer is an adhesive.

9. The musical instrument for preventing a player's body from damping vibrations according to claim 7, wherein a layer structure is provided by an adhesive layer, said material layer and an adhesive layer.

10. The musical instrument for preventing a player's body from damping vibrations according to claim 1, wherein said neck and said block form a continuous structure.

11. The musical instrument for preventing a player's body from damping vibrations according to claim 1, wherein said annular plate, said neck and said block form a continuous structure.

12. The musical instrument for preventing a player's body from damping vibrations according to claim 1, wherein said bottom cover has an opening that is able to closed off by a lid.

13. The musical instrument for preventing a player's body from damping vibrations according to claim 1, wherein said indirect sound production portion comprises at least one pickup for converting vibrations of said at least one string to electric signals.

14. The musical instrument for preventing a player's body from damping vibrations according to claim 1, wherein said musical instrument is an electric guitar.

* * * * *